US006619004B2

(12) United States Patent
Loper

(10) Patent No.: US 6,619,004 B2
(45) Date of Patent: Sep. 16, 2003

(54) WATER DRAINING EXTERIOR WALL STRUCTURE

(76) Inventor: William Loper, 22 W. Meadow Dr., Vail, CO (US) 81657

( * ) Notice: Subject to any disclaimer, the term of this patent is extended or adjusted under 35 U.S.C. 154(b) by 45 days.

(21) Appl. No.: 09/946,384

(22) Filed: Sep. 4, 2001

(65) Prior Publication Data

US 2002/0029535 A1 Mar. 14, 2002

Related U.S. Application Data

(60) Provisional application No. 60/232,607, filed on Sep. 14, 2000.

(51) Int. Cl.[7] ..... E04B 1/70

(52) U.S. Cl. ..... 52/302.1; 52/483.1; 52/235

(58) Field of Search ..... 52/209, 302.1, 52/302.3, 302.7, 385, 235, 483.1, 674

(56) References Cited

U.S. PATENT DOCUMENTS 4,282,691 A * 8/1981 Risdon ..... 52/101
4,506,482 A 3/1985 Pracht et al.
4,545,161 A * 10/1985 Baumann ..... 52/235
4,783,941 A 11/1988 Loper et al.
5,218,798 A * 6/1993 Bentivegna et al. ..... 52/206
5,289,664 A * 3/1994 Rizza et al. ..... 52/302.1
5,598,671 A * 2/1997 Ting ..... 52/235
5,749,282 A * 5/1998 Brow et al. ..... 52/235
6,301,849 B1 * 10/2001 Roth ..... 52/302.6

* cited by examiner

*Primary Examiner*—Carl D. Friedman
*Assistant Examiner*—Brian E. Glessner
(74) *Attorney, Agent, or Firm*—Brian D. Smith, P.C.

(57) ABSTRACT

A water draining exterior wall structure for a building having a building framework is disclosed. The wall structure includes a plurality of prefabricated panel sections secured to a building framework to form a wall surface. Each panel section includes a support structure for attachment to the building framework which has a water barrier deck substantially co-extensive with the support structure. In addition, a plurality of fascia panels overly the water barrier deck and are attached thereto by beads of silicone adhesive so that a gap is provided between the deck and each fascia panel. A gutter is also provided in each panel which extends along the bottom of each panel section for collecting water entering the gap and carrying the collected water to a drainage end of said gutter so that water can drain out of said panel section. Water drainage dams are also provided, each of which is located in a joint between adjacent panel sections below the drainage end of a gutter of each panel section. Each dam (1) receives water having drained out of the gutter(s) located immediately above it and (2) directs the received water out of the joint in which said dam is located, thereby draining water from said wall structure.

9 Claims, 2 Drawing Sheets

WATER DRAINING EXTERIOR WALL STRUCTURE

CROSS REFERENCE TO RELATED APPLICATION

This application is a nonprovisional application claiming the benefit under 35 USC 119(e) of U.S. provisional application Ser. No. 60/232,607, filed on Sep. 14, 2000.

FIELD OF THE INVENTION

This invention relates to the field of building exterior wall construction and more particularly to the construction of building walls using prefabricated panels covered with a plurality of fascia panels or tiles mounted to the panel supporting structure.

BACKGROUND OF THE INVENTION

U.S. Pat. No. 4,506,482 discloses a prefabricated wall panel in which a rigid support structure is covered on one side with a plurality of fascia panels, such as tiles, resiliently secured thereto. A plurality of such prefabricated wall panels are fastened to a building's framework to form an exterior wall thereof. While such arrangement is generally satisfactory, it has been found that on occasion water or moisture can enter the panel. Accordingly, it would be desirable if such a panel or wall construction had the capability of draining such water from the panel.

SUMMARY OF THE INVENTION

The present invention provides a drainage system for prefabricated building panels and wall structures built therefrom. The wall structure of the present invention includes a plurality of prefabricated panel sections which are secured to a building framework to form a wall surface thereon. Each panel section is attached to the building framework via its support structure which additionally is provided with a water barrier deck in accordance with the present invention. The water barrier deck is substantially co-extensive with the support structure. In addition, the wall structure includes a plurality of fascia panels are attached to and overlie the outer surface of the water barrier deck. The fascia panels are attached to the water barrier, preferably with beads of a silicone adhesive, so that a gap is provided between the deck and each fascia panel. The gap is designed so that water entering the panel runs down the face of the deck in the gap between the deck and the underside of the fascia panels. This water is collected in a gutter extending along a bottom edge of the support structure. In addition to collecting water, the gutter carries the collected water to a drainage end(s) of the gutter where it is received by a water drainage means of the present invention. The water drainage means directs the received water out through the joint located between adjacent panel sections. As such, water entering a panel section is automatically drained therefrom. In addition, the wall structure of the present invention is provided with means such as caulking for sealing the joints between adjacent edges of the fascia panels.

In a preferred embodiment of the present invention, the water drainage means includes a water drainage dam or system which is located in the joint between the vertically disposed sides of adjoining panel sections. The dam is preferably made by caulking this joint with a strip of caulk which serves to seal the joint. The strip of caulk is oriented so that it extends downwardly along the sides of the adjoining panel sections from the back surfaces thereof to the front surfaces thereof. By inclining or orienting the caulk downwardly, water drainage out of the dam is facilitated.

BRIEF DESCRIPTION OF THE DRAWINGS

The invention will be more readily understood by reference to the accompanying drawings wherein like reference numerals indicate like elements, and in which.

DETAILED DESCRIPTION OF THE PREFERRED EMBODIMENT

U.S. Pat. No. 4,506,482, which is incorporated herein by reference, shows in FIG. 1 thereof a building wall made up of a plurality of prefabricated panel sections which are secured to the building framework. Each of the panel sections has a plurality of fascia sheets, or tiles, which are adhesively secured to an underlying rigid support structure. The tiles are formed of materials selected from the group consisting of ceramics and masonry. For example granite, marble and ceramic tiles are available in many different sizes, colors and textures.

Figure 1:
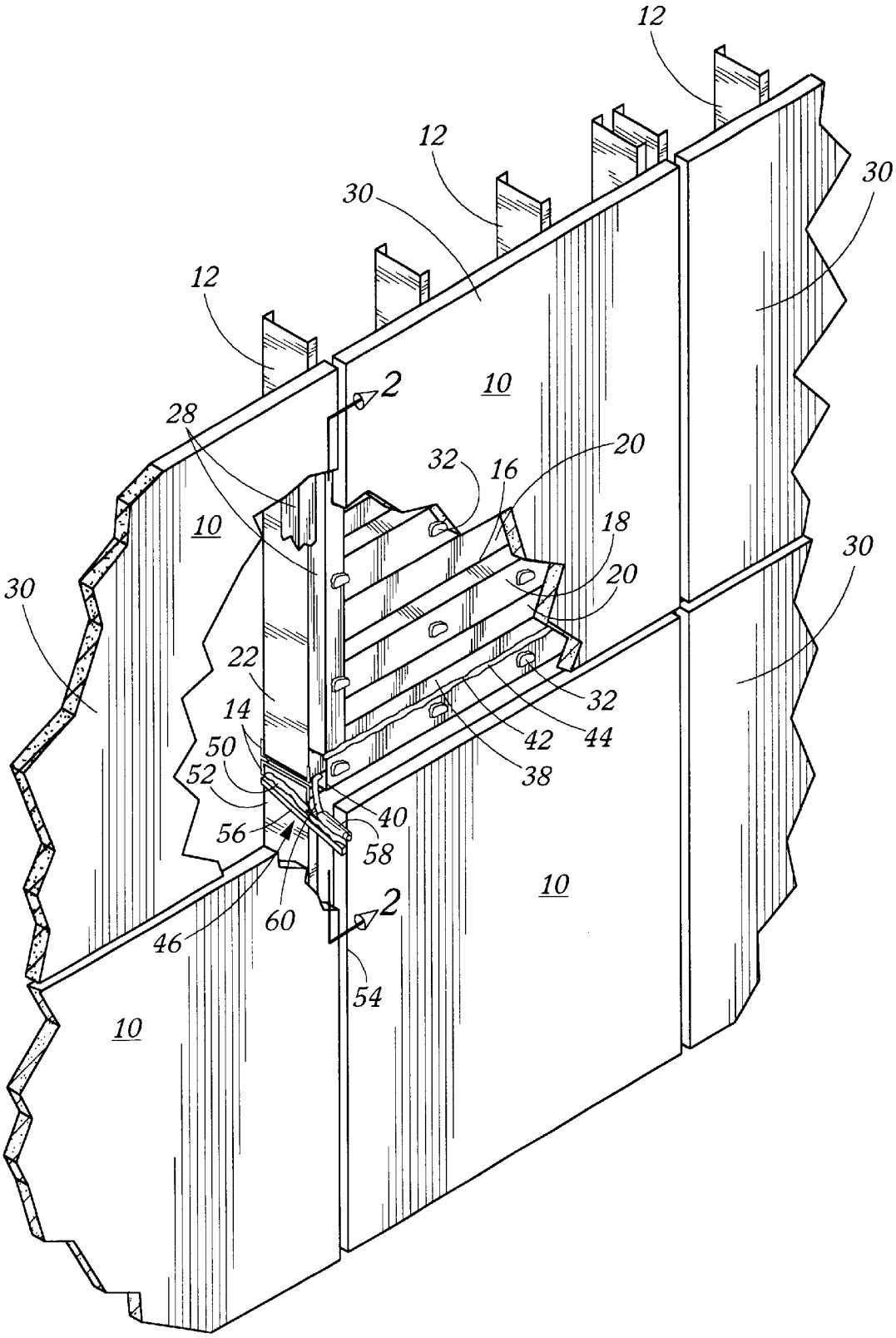
FIG. 1 is a perspective fragmentary view, with portions broken out to show the details of a building wall panel embodying the invention.
Figure 2:
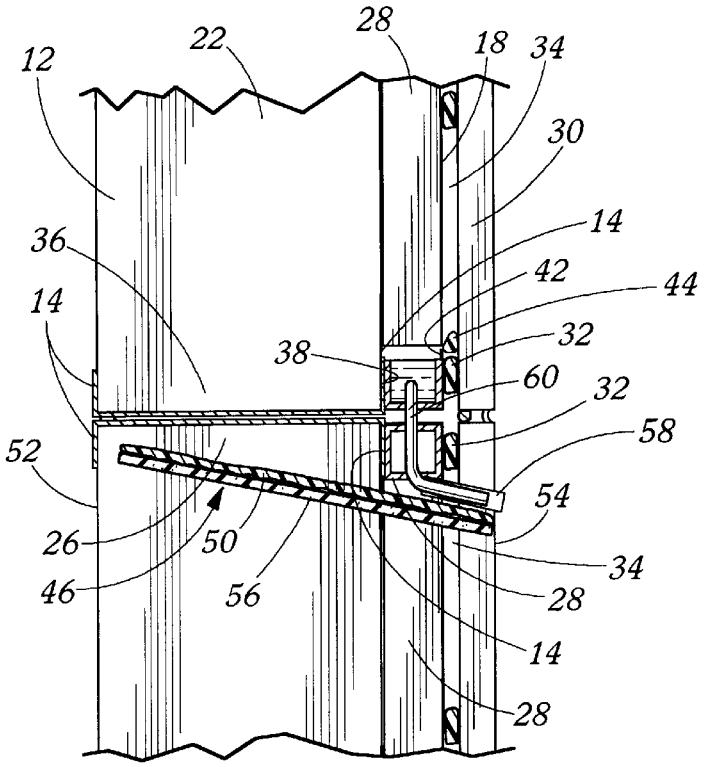
FIG. 2 is a cross-sectional view taken along lines 2—2 of FIG. 1.

In FIG. 1 hereof, a panel section 10 similar to that of the above '482 patent, is shown which has been improved to provide it with the water drainage system of the present invention. Panel section 10 comprises a structural frame (not numbered) which generally consists of vertically arranged galvanized steel studs 12 which are welded at their ends to a perimeter U-shaped track 14 also of galvanized steel. One side of the frame is covered by a water impermeable steel deck 16 also of galvanized steel and referred to herein as a water barrier deck. The deck is preferably formed having a series of parallel ridges 18 and grooves 20 referred to in the trade as hats 18 and valleys 20, respectively. Valleys 20 are preferably attached to the rigid support structure such as studs 12 by welding, riveting or screwing. The sides 22, 24 and top 26 of the deck are closed at the perimeter track 14 by an edge closure or tube 28 which is welded or otherwise secured to the deck 16 and the track 14. The tiles or fascia panels 30 are attached to the hats 18 of the deck 16 using beads 32 of a silicone based adhesive as described in U.S. Pat. No. 4,506,482 and may in addition be attached by rigid fasteners as described in my previously issued U.S. Pat. No. 4,783,941 which is hereby incorporated by reference. As best shown in FIG. 2, the beads 32 of silicon adhesive serve to space the tiles 30 from the surface of the hats 18 so that a gap 34 is provided between the surface of the hat and the underside of each fascia panel.

As indicated above, the top and sides of the deck 16 are closed by square tube 28. In accordance with an important aspect of the present invention, the bottom 36 of deck 16 including its lowermost valley 20 is closed with a U-shaped channel or gutter 38 which extends along the lowermost valley 20. As its name "gutter" indicates, gutter 38 serves to collect water entering gap 34 and convey the collected water to its respective ends which are referred to herein as drainage ends 40 of the gutter. Gutter 38 is welded or otherwise secured to deck 16 in a fashion similar to that used for attaching square tube 28 to deck 16. In addition, gutter 38 is sealed along its outer top edge 42 with a strip of caulk 44 which seals gap 34 between the gutter's top edge 42 and the underside surface of the opposing tiles 30 to insure that water entering the panel collects in the gutter.

Water carried to the gutter's drainage ends then enters the water drainage means or dam 46 of the present invention which as shown in the drawings is preferably located immediately below the gutter drainage end(s) 40 in the joint 48 located between the vertically disposed sides 22, 24 of adjacent panel sections of the building's wall structure. Each water drainage dam as indicated (1) receives water from the drainage ends of the gutter and (2) directs the received water out through the joint 48 between the adjacent panel sections, thereby draining water from the wall structure. As shown, each dam includes a strip 50 of caulk located in joint 48 which seals the joint and as shown extends downwardly along the sides of the panel sections from the back edges 52 thereof to the front edges 54 thereof. By inclining or orienting the strip downwardly as shown, water drainage out of the dam due to the action of gravity is facilitated. As also shown, each caulk strip 50 is supported by a backer rod 56 comprising a polyethylene foam strip. The backer rod is compressed into joint 48 and, as such, provides a base against which caulk strip 50 may lie.

Each dam also has a hollow tube 58 which extends from the dam's interior section (not numbered) to and through the exterior of the joint in which the dam is located. Since the tube as shown is inclined at the same angle as caulk strip 50 it also facilitates the drainage of water from the dam and thereby the wall structure. The tube's inside diameter would normally be about ¼ of an inch.

In addition, each dam further includes at least one wick 60 which extends from each drainage end 40 of the gutter into tube 58. Wick 60 is preferably made from conventional wick material such as cotton and serves to facilitate water drainage from the gutter into the tube and in particular serves to prevent water from migrating back inwardly along the underside of the gutter as is known to those skilled in the relevant art. Since each dam will typically collect water from two adjacent panel sections, each dam will usually have two wicks, one for each panel.

Figure 3:
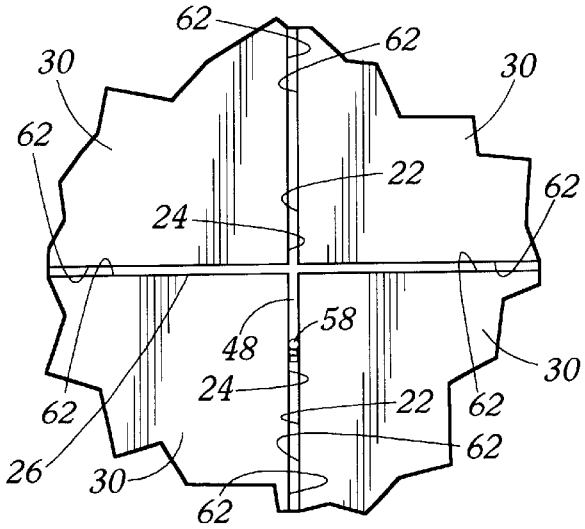
FIG. 3 is a partial front elevation showing the intersection of four prefabricated building wall panels embodying the invention of the present invention as they would appear on the wall of building.

All joints between the edges 62 of adjoining tiles including those of adjacent panels such as those shown in FIG. 3 are also caulked as in done conventionally and explained in the patents incorporated herein by reference. This would include the area of each joint in which a tube 58 is located. Thus, each water draining dam will be completely concealed from view except for the end of tube 58 which will preferably project outwardly from the surface of the caulked joint about ¼ to ⅜ of an inch. Be that as it may, tubes 58 will generally not be very conspicuous since they are preferably made from clear plastic tubing or a material similar in color to that of the caulk. The caulking and tubes 58 may also be painted which will also make the tubes less conspicuous.

While a certain illustrative embodiment of the present invention has been shown in the drawings and described above in detail, it should be understood that there is no intention to limit the invention to the specific form and embodiment disclosed. On the contrary, the intention is to cover all modifications, alternative constructions, equivalents and uses falling within the spirit and scope of the invention as expressed in the appended claims.

I claim:

1. A water draining exterior wall structure for a building having a building framework, said wall structure comprising:

a plurality of prefabricated panel sections secured to a building framework to form a wall surface wherein each panel section includes:

a support structure for attachment to the framework of a building, said support structure having a water barrier deck substantially co-extensive with the support structure, said deck having an outer surface;

a plurality of fascia panels attached to and overlying said outer surface of said water barrier deck;

means for attaching said fascia panels to said water barrier deck so that a gap is provided between said deck and each fascia panel; and a gutter disposed and extending along the bottom of said support structure for collecting water entering the gap and carrying the collected water to a drainage end of said gutter so that water can drain out of said panel section;

a plurality of water drainage dams, each dam being located in a joint between adjacent panel sections below a said drainage end of a said gutter of a said panel section located immediately above said adjacent panel sections, each dam including a strip of caulk located in the joint between the vertically disposed sides of adjacent panel sections, said strip of caulk sealing the joint and extending downwardly along said sides of said panel sections from the back surfaces of said adjacent panel sections to the front surfaces of said adjacent panel sections so as to facilitate the drainage of water out of the dam, each said d also (1) receiving water having drained out of the gutter located immediately above it and (2) directing the received water out of the joint in which said dam is located, thereby draining water from said wall structure; and means for sealing the joints between adjacent edges of aid fascia panels.

2. A water draining exterior wall structure as claimed in claim 1 wherein said means for attaching said fascia panels to said water barrier deck includes silicone adhesive.

3. A water draining exterior wall structure as claimed in claim 1 wherein said support structure includes a structural frame with said water barrier de k overlying one side of the frame and rigidly secured thereto.

4. A water draining exterior wall structure as claimed in claim 2 wherein said attaching means includes beads of said silicone adhesive which are interspersed between said deck and the underside of said fascia panels to attach said fascia panels to said deck.

5. A water draining exterior wall structure as claimed in claim 1 wherein said water barrier deck is formed to have parallel hats and valleys.

6. A water draining exterior wall structure as claimed in claim 1 further comprising a wick extending from said drainage end of said gutter through aid water drainage dam to the joint in which said dam is located, said wick serving to facilitate the drainage of water from the gutter and the dam and thereby the wall structure.

7. A water draining exterior wall structure as claimed in claim 1 further comprising a tube extending from said water drainage darn to and through the exterior of the joint in which said dam is located, said tube serving to facilitate the drainage f water from the gutter and the dam and thereby the wall structure.

8. A water draining exterior wall structure as claimed in claim 7 further comprising a wick extending from said drainage end of said gutter to and into said tube, said wick serving to facilitate the drainage of water from the gutter and the dam and thereby the wall structure.

9. A water draining exterior wall structure as claimed in claim 1 wherein each dam further includes a strip of open cell foam backer rod located directly beneath said strip of caulk for supporting said strip of caulk.

* * * * *